US007291786B2

(12) United States Patent
Matsui et al.

(10) Patent No.: US 7,291,786 B2
(45) Date of Patent: Nov. 6, 2007

(54) DIFFERENTIAL SIGNAL TRANSMISSION CABLE

(75) Inventors: Hakaru Matsui, Hitachi (JP); Hiroshi Komuro, Hitachi (JP); Nobuhito Akutsu, Hitachi (JP); Fumitaka Nakahigashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/580,426

(22) PCT Filed: Apr. 7, 2005

(86) PCT No.: PCT/JP2005/007271

§ 371 (c)(1),
(2), (4) Date: May 24, 2006

(87) PCT Pub. No.: WO2006/003746

PCT Pub. Date: Jan. 12, 2006

(65) Prior Publication Data

US 2007/0068696 A1 Mar. 29, 2007

(30) Foreign Application Priority Data

Jun. 30, 2004 (JP) ..... 2004-194156

(51) Int. Cl.
*H01B 7/00* (2006.01)

(52) U.S. Cl. ..... 174/113 R; 174/102 R

(58) Field of Classification Search ..... 174/113 R, 174/102 R, 108
See application file for complete search history.

(56) References Cited

U.S. PATENT DOCUMENTS

| | | | | |
|---|---|---|---|---|
| 3,433,884 | A * | 3/1969 | Martin et al. | 174/507 |
| 3,999,003 | A * | 12/1976 | Chevrolet et al. | 174/23 R |
| 5,521,333 | A | 5/1996 | Kobayashi et al. | |
| 5,574,250 | A | 11/1996 | Hardie et al. | |
| 6,169,251 | B1 * | 1/2001 | Grant et al. | 174/113 R |
| 6,495,759 | B1 | 12/2002 | Yamamoto et al. | |
| 2005/0029006 | A1 | 2/2005 | Takahashi et al. | |

FOREIGN PATENT DOCUMENTS

| | | | |
|---|---|---|---|
| JP | 63-000414 | U | 1/1988 |
| JP | 63-121331 | U | 8/1988 |
| JP | 4-092321 | U | 8/1992 |
| JP | 7-014438 | A | 1/1995 |
| JP | 11-144532 | A | 5/1999 |
| JP | 2002-015628 | A | 1/2002 |
| JP | 2002-352640 | A | 12/2002 |
| JP | 2003-022718 | A | 1/2003 |
| JP | 2003-132743 | A | 5/2003 |

* cited by examiner

*Primary Examiner*—Chau N. Nguyen
(74) *Attorney, Agent, or Firm*—Foley & Lardner LLP

(57) ABSTRACT

A differential signal transmission cable has four stranded cores, each formed of an inner conductor covered with an insulation of fluorocarbon resin; an outer conductor being spirally wrapped around the four stranded cores in the opposite direction to a stranding direction of the cores; and a sheath formed around the outer conductor, where the diameter of the cable is 1.0 mm or less.

5 Claims, 5 Drawing Sheets

DIFFERENTIAL SIGNAL TRANSMISSION CABLE

The present application is based on Japanese patent application No. 2004-194156, the entire contents of which are incorporated herein by reference.

TECHNICAL FIELD

The present invention relates to a differential signal transmission cable used in a bending portion of small-size electronic devices, and in particular, to a differential signal transmission cable excellent in electrical and mechanical properties and suitable for transmitting image signals of liquid crystal displays of mobile phones.

BACKGROUND ART

In cables used for signal transmission of small-size liquid crystal displays such as those of notebook PCs, mobile phones, etc., electrical properties such as EMI (electromagnetic interference) prevention, low skew (low difference in transmission delay between pairs), etc. are required. Also, because of wiring via a small hinge whose hole diameter is 5 mm or less, making small diameter cables has become important.

FIG. 1 illustrates an example of structure of a micro coaxial cable used in such applications. This micro coaxial cable 10 comprises, sequentially around an inner conductor 11 made of Sn-plated copper wires, etc., an insulation 12 made of PFA (Teflon (trademark)) resin, etc., an outer conductor 13 made of Sn-plated copper wires, etc., and a sheath 14 made of polyester, etc., in which its outside diameter is on the order of 0.35 mm (e.g., see Japanese patent application laid-open No. 2002-352640).

Notebook PCs have transitioned from parallel to serial signal transmission, which requires stricter electrical properties than characteristics of the above micro coaxial cable, so that a twin-axial cable is applied to notebook PCs.

FIG. 2 illustrates an example of structure of a twin-axial cable. This twin-axial cable 20 comprises two parallel-arranged cores each having an inner conductor 21 made of copper alloy wires, etc. which is covered with an insulation 22 made of polyethylene, etc., an outer conductor 23 made of copper alloy wires, etc. as an outer conductor around those two cores, and a sheath 24 made of polyester, etc. (e.g., see Japanese patent application laid-open No. 2003-22718).

On the other hand, present mobile phones use parallel transmission using about forty-bundled micro coaxial cables for signal transmission of their liquid crystal display. By changing this parallel transmission to serial transmission, the number of signal lines can be reduced to about ten.

Transitioning to such serial transmission may cause noise from a cable to be transmitted to a motherboard, which may result in a malfunction. For this reason, an excellent electric characteristic cable such as the twin-axial cable is indispensable.

By comparison with the micro coaxial cable, however, the twin-axial cable has low mechanical properties such as bending and twisting, which is not suitable for application to mobile phones which are subject to severe bending and twisting.

DISCLOSURE OF INVENTION

Accordingly, it is an object of the present invention to provide a differential signal transmission cable which is excellent in mechanical properties such as bending and twisting as well as electrical properties, and which is suitable for signal transmission cables for liquid crystal displays of mobile phones To achieve the above object, the present invention provides a differential signal transmission cable comprising a plurality of stranded cores, each comprising an inner conductor covered with an insulation; an outer conductor being spirally wrapped around the plurality of stranded cores in the opposite direction to a stranding direction of the cores; and a sheath provided around the outer conductor, where the diameter of the cable is 1.0 mm or less.

The above plurality of stranded cores may comprise four stranded cores. Also, the pitch of stranding is preferably not more than forty times the layered core diameter.

The above inner conductors may use stranded wires of silver-plated copper alloy whose diameter is 0.05 mm or less; the above insulation may use fluorocarbon resin; and the above outer conductor may use silver-plated copper alloy stranded wires whose diameter is 0.05 mm or less.

The above sheath may be made from a fluorocarbon resin or a laminate of a copper-plated polyester tape and a polyester tape.

When the cores are stranded, filler such as polyester fiber may be located at the center. When the cores are stranded, a polyester tape, or a copper-metalized or -plated polyester tape may also be wrapped for holding shape after stranding.

The above differential signal transmission cable may be used in transmitting image signals of liquid crystal displays of mobile phones.

BRIEF DESCRIPTION OF DRAWINGS

The preferred embodiments according to the invention will be explained below referring to the drawings, wherein.

BEST MODE FOR CARRYING OUT THE INVENTION

Figure 3:
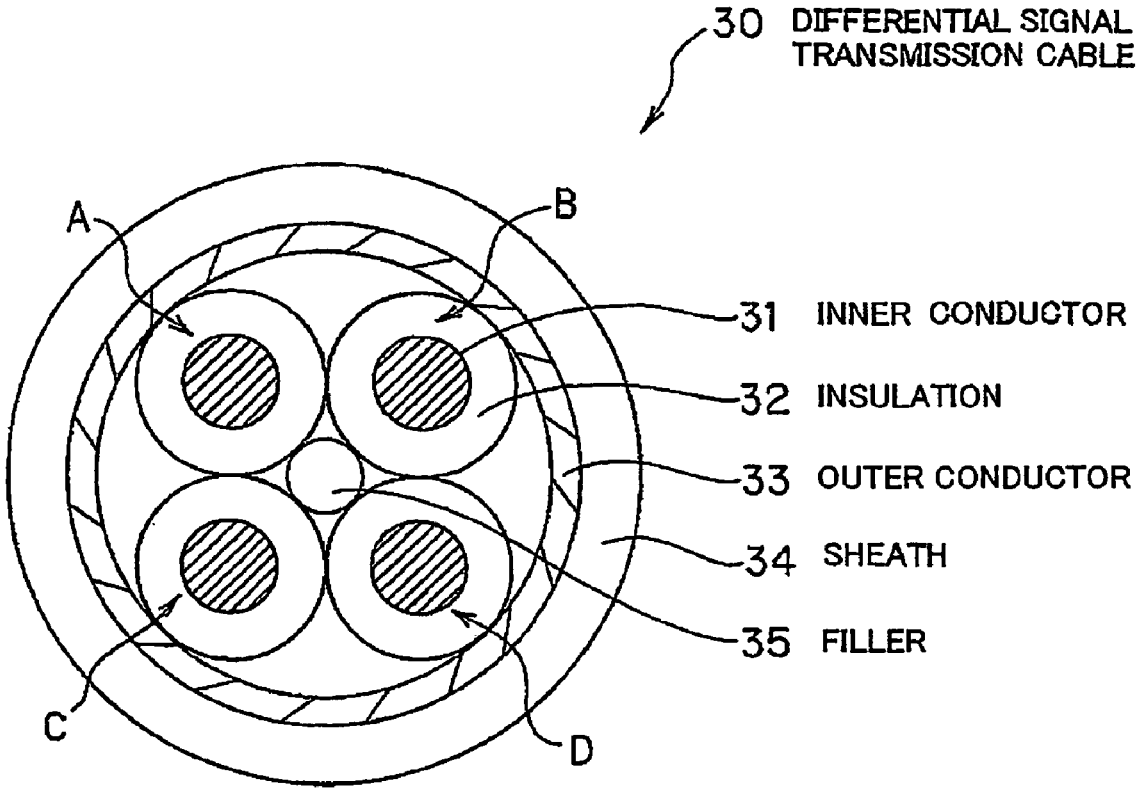
FIG. 3 is a cross-sectional view illustrating one embodiment of a differential signal transmission cable according to the invention.

FIG. 3 illustrates one embodiment of a differential signal transmission cable according to the invention. This differential signal transmission cable 30 comprises four stranded cores, each comprising an inner conductor 31 covered with an insulation 32 of fluorocarbon resin; an outer conductor 33 being spirally wrapped around the four stranded cores in the opposite direction to a stranding direction of the cores; and a sheath 34 formed around the outer conductor 33. Here, the diameter of the cable is 1.0 mm or less, so that it passes via a hinge of a mobile phone; it is subject to being twisted repeatedly; the number of signal transmission wires increases as liquid crystals are made finer, and so on.

The inner conductor 31 may comprise silver-plated copper alloy stranded wires. It is preferred that the silver-plated copper alloy wires are of higher conductivity, but since mobile phone harnesses are used on the order of 100 mm, silver-plated copper alloy wires may be of 70% IACS or more. It is also preferred that the tensile strength is higher, but may be 700 MPa or more. The thickness of the silver plating may be on the order of 1 μm so that it is used mainly in a band of 800 MHz-I. 9 GHz, and at a maximum of around 6 GHz.

The insulation 32 is desirably a material which can be extruded thin, and which has a stable dielectric constant and dielectric loss tangent in a frequency band of up to 6 GHz, especially 800 MHz-I. 9 GHz. Desirable for such a material is fluorocarbon resin, more preferably, PFA (perfluoroalkyl-tetrafluoroethylene copolymer), TFE/HFP (tetrafluoroethylene-hexafluoropropylene copolymer (4- and 6-fluorinated)), or PTFE (polytetrafluoroethyloene (4-fluorinated)). The thickness is desirably adjusted to a thickness whose characteristic impedance is 90-100 Ω between diagonal cores. Surface treatment may be made to the insulation 32. It is acceptable to make a high electrical-conductivity metal (e.g., copper) layer on the surface of the insulation 32. It can be sputtering or plating.

The pitch of stranded cores is desirably not more than forty times the layered core diameter (a diameter of a circle formed by connecting centers of the four cores). By taking the pitch to be not more than forty times the layered core diameter, use in a mobile phone can reduce effects on a transmitting/receiving circuit. During stranding, polyester yarn 35 may be located at the center. Further, a polyester tape, or a copper-metalized or -plated polyester tape may also be wrapped for holding shape after the stranding.

The outer conductor 33 is desirably the same material as that of the inner conductor, but may be a different material therefrom. The wrapping direction is preferably the opposite direction to a stranding direction of the cores, which results in structural stability. This is because, in case the wrapping direction is the same as a stranding direction of the cores, the outer conductor falls into a groove formed by the stranding of the cores, and thereby becomes unstable. It is noted that, even in case the wrapping direction is the same as a stranding direction of the cores, there is no problem caused if the outer conductor does not fall into a groove formed by the stranding of the cores. Also, double spiral wrapping of the outer conductor 33 enhances shielding characteristics.

The sheath 34 may be made of a fluorocarbon resin or a laminate of a copper-plated (-metalized) polyester tape and a polyester tape. It is noted that it is not limited thereto if a material which is thin and unaffected by repeated bendings is used.

EXAMPLES

Using materials, thicknesses and wire diameters shown in Table 1, a differential signal transmission cable illustrated in FIG. 3 was fabricated, and bending and twisting properties were assessed.

TABLE 1

| | Inner conductor | Insulation | | Tape | Outer conductor | | Sheath | |
|---|---|---|---|---|---|---|---|---|
| Example | Configuration | Material | Thickness | wrapping | Configuration | Wire diameter | Material | Outside diameter |
| 1 | 7/0.025 mm | PFA | 0.05 mm | none | Spiral wrapping (single) | 0.025 mm | PFA | 0.57 mm |
| 2 | 7/0.025 mm | PFA | 0.05 mm | none | Spiral wrapping (single) | 0.03 mm | PFA | 0.58 mm |
| 3 | 7/0.03 mm | PFA | 0.06 mm | none | Spiral wrapping (single) | 0.025 mm | PFA | 0.66 mm |
| 4 | 7/0.03 mm | PFA | 0.06 mm | none | Spiral wrapping (single) | 0.03 mm | PFA | 0.67 mm |
| 5 | 7/0.04 mm | PFA | 0.08 mm | none | Spiral wrapping (single) | 0.03 mm | PFA | 0.75 mm |
| 6 | 7/0.04 mm | PFA | 0.08 mm | none | Spiral wrapping (single) | 0.04 mm | PFA | 0.77 mm |
| 7 | 7/0.025 mm | PFA | 0.05 mm | Cu-plated PE tape*1 | Spiral wrapping (single) | 0.025 mm | PFA | 0.59 mm |
| 8 | 7/0.025 mm | PFA | 0.05 mm | Cu-plated PE tape*1 | Spiral wrapping (single) | 0.03 mm | PFA | 0.60 mm |
| 9 | 7/0.03 mm | PFA | 0.06 mm | Cu-plated PE tape*1 | Spiral wrapping (single) | 0.025 mm | PFA | 0.68 mm |
| 10 | 7/0.03 mm | PFA | 0.06 mm | Cu-plated PE tape*1 | Spiral wrapping (single) | 0.03 mm | PFA | 0.69 mm |
| 11 | 7/0.04 mm | PFA | 0.08 mm | Cu-plated PE tape*1 | Spiral wrapping (single) | 0.03 mm | PFA | 0.77 mm |
| 12 | 7/0.04 mm | PFA | 0.08 mm | Cu-plated PE tape*1 | Spiral wrapping (single) | 0.04 mm | PFA | 0.79 mm |
| 13 | 7/0.025 mm | PFA | 0.05 mm | none | Spiral wrapping (single) | 0.025 mm | PFA | 0.53 mm |
| 14 | 7/0.025 mm | PFA | 0.05 mm | none | Spiral wrapping (single) | 0.03 mm | Composite PE tape*2 | 0.54 mm |
| 15 | 7/0.03 mm | PFA | 0.06 mm | none | Spiral wrapping (single) | 0.025 mm | Composite PE tape*2 | 0.62 mm |
| 16 | 7/0.03 mm | PFA | 0.06 mm | none | Spiral wrapping (single) | 0.03 mm | Composite PE tape*2 | 0.63 mm |
| 17 | 7/0.04 mm | PFA | 0.08 mm | none | Spiral wrapping (single) | 0.03 mm | Composite PE tape*2 | 0.71 mm |
| 18 | 7/0.04 mm | PFA | 0.08 mm | none | Spiral wrapping (single) | 0.04 mm | Composite PE tape*2 | 0.73 mm |
| 19 | 7/0.025 mm | PFA | 0.05 mm | none | Double spiral wrapping | 0.025 mm | PFA | 0.62 mm |

TABLE 1-continued

| Example | Inner conductor Configuration | Insulation Material | Insulation Thickness | Tape wrapping | Outer conductor Configuration | Outer conductor Wire diameter | Sheath Material | Sheath Outside diameter |
|---|---|---|---|---|---|---|---|---|
| 20 | 7/0.025 mm | PFA | 0.05 mm | none | Double spiral wrapping | 0.03 mm | PFA | 0.64 mm |
| 21 | 7/0.03 mm | PFA | 0.06 mm | none | Double spiral wrapping | 0.025 mm | PFA | 0.71 mm |
| 22 | 7/0.03 mm | PFA | 0.06 mm | none | Double spiral wrapping | 0.03 mm | PFA | 0.73 mm |
| 23 | 7/0.04 mm | PFA | 0.08 mm | none | Double spiral wrapping | 0.03 mm | PFA | 0.81 mm |
| 24 | 7/0.04 mm | PFA | 0.08 mm | none | Double spiral wrapping | 0.04 mm | PFA | 0.85 mm |

Figure 4:
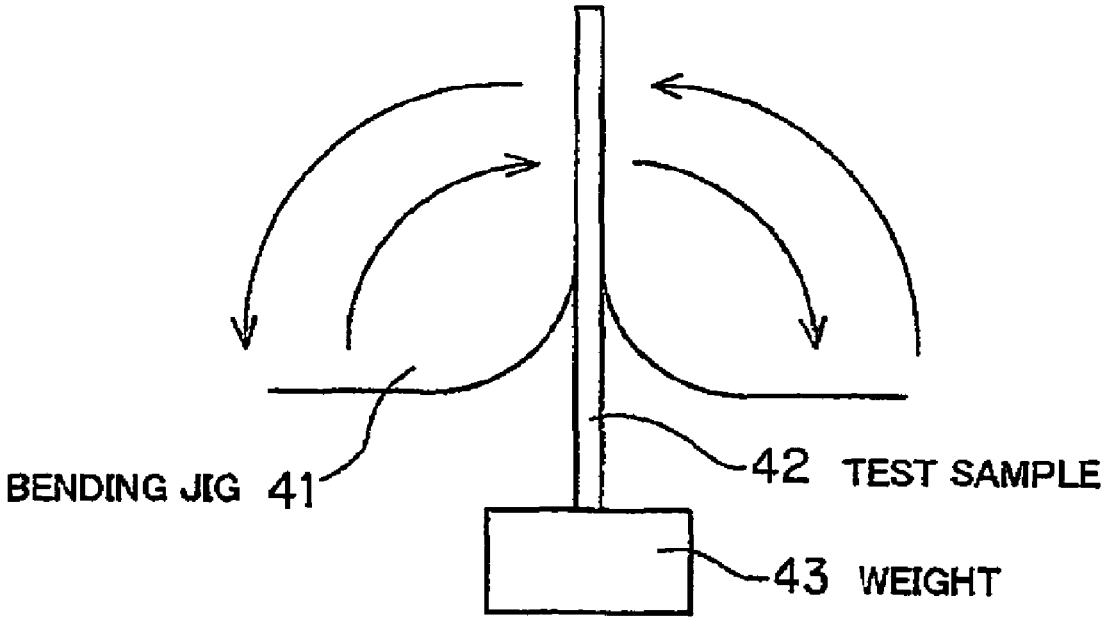
FIG. 4 is a schematic view for explaining a testing method of bending properties.

Cu-plated PE tape*1: Cu-plated polyester tape
Composite PE tape*2: Cu-plated polyester tape + polyester tape Bending properties were assessed by a testing method illustrated in FIG. 4. This testing method comprises connecting four inner conductor cores of one cable in series to form a test sample 42, and attaching thereto a weight 43 of 50 gf; and bending left and right (the bending angle is 90 degree) with a radius of 2 mm at a testing speed of 30 times/min until breaking, and measuring the number of times until breaking.

Figure 5:
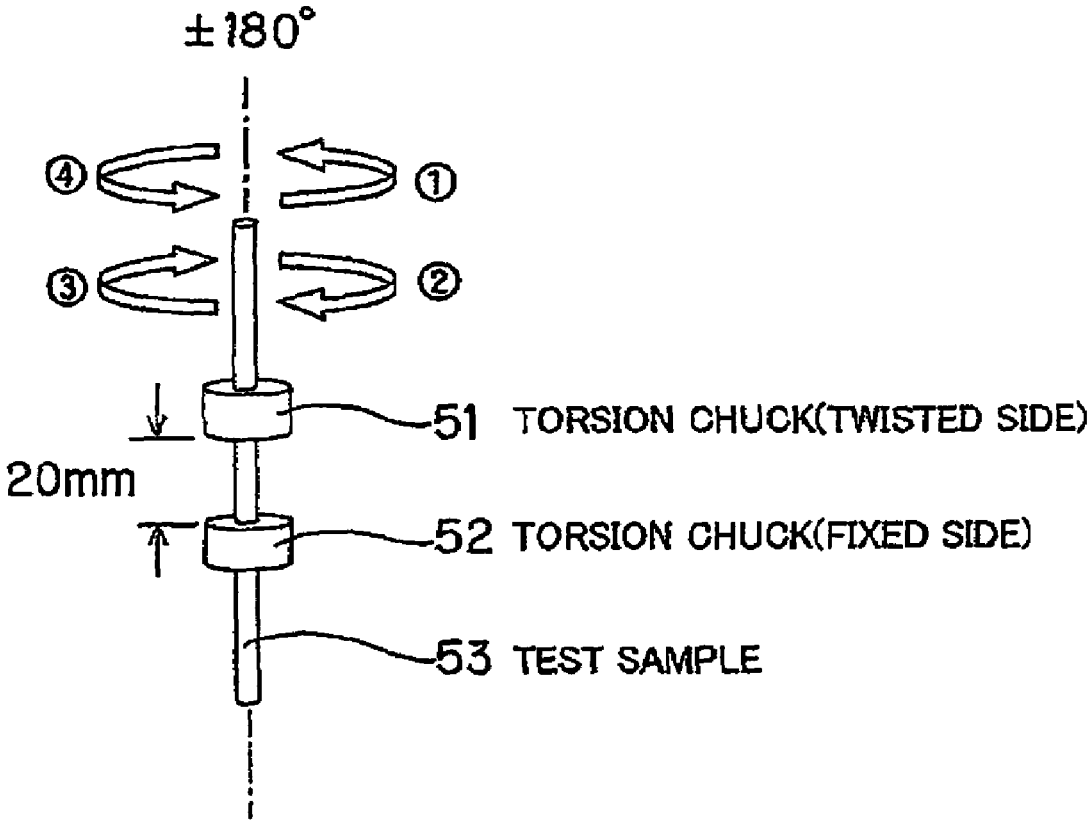
FIG. 5 is a schematic view for explaining a testing method of twisting properties.

Twisting properties were assessed by a testing method illustrated in FIG. 5. This testing method comprises connecting inner conductors in series to form a test sample 53, and attaching thereto a torsion chuck 51 (twisted side) and a torsion chuck 52 (fixed side); and repeating twisting the test sample 53 in the 180-degree left and right directions (I)—(4) with a twisting distance of 20 mm, with a weight of 50 gf, at a testing speed of 30 times/min until breaking, and measuring the number of times until breaking.

The result of measuring bending and twisting properties shows that the lifetimes of bending the differential signal transmission cables of Examples 1-24 were all more than 20,000 times. Also, the lifetimes of twisting the differential signal transmission cables of Examples 1-24 were all more than 200,000 times.

Comparative Examples

Figure 1:
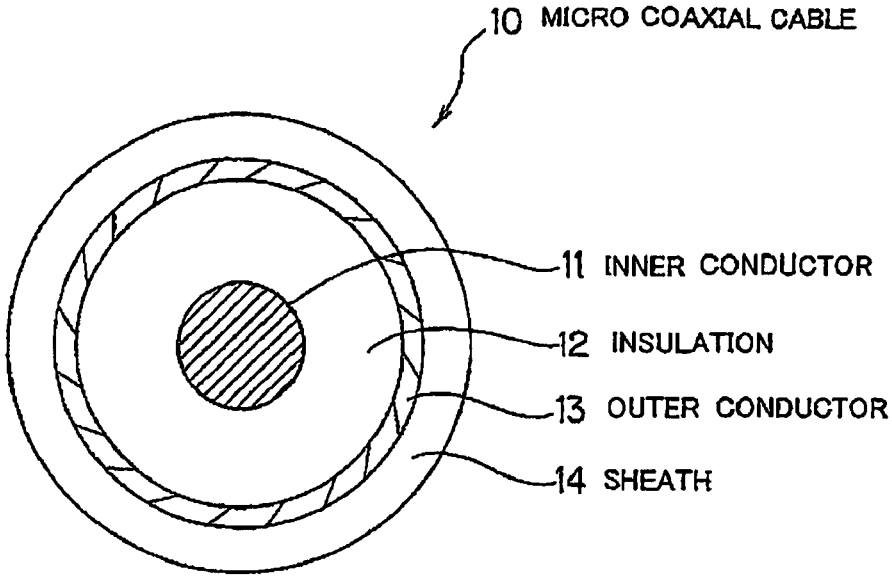
FIG. 1 (Prior Art)
FIG. 1 is a cross-sectional view illustrating a conventional micro coaxial cable.
Figure 2:
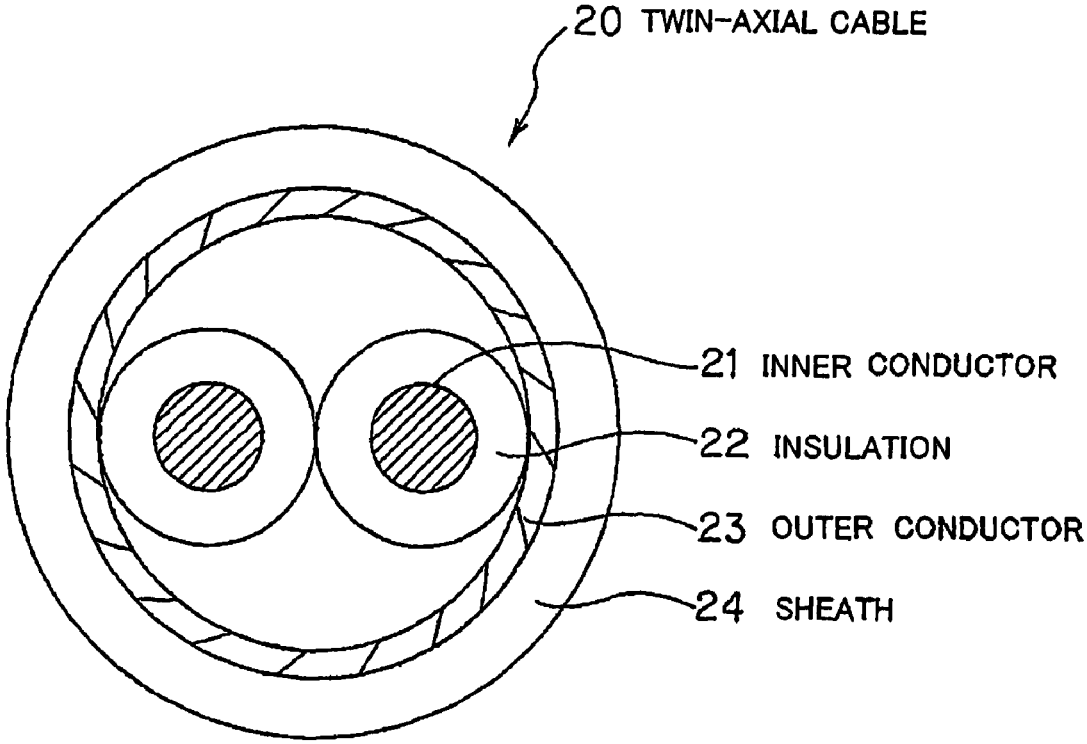
FIG. 2 (Prior Art)
FIG. 2 is a cross-sectional view illustrating a conventional twin-axial cable.

Using materials, thicknesses and wire diameters shown in Table 2, a micro coaxial cable illustrated in FIG. 1 and a twin-axial cable illustrated in FIG. 2 were fabricated, and bending and twisting properties were assessed.

TABLE 2

| Comparative example | Structure | Inner condcutor Configuration | Inner condcutor Wire diameter | Inner condcutor Material | Insulation Material | Insulation Thickness | Outer conductor Configuration | Outer conductor Material | Sheath Material | Sheath Outside diameter |
|---|---|---|---|---|---|---|---|---|---|---|
| 1 | micro coaxial cable | stranded wires | 7/0.025 mm | Sn-plated copper alloy | PFA | 0.06 mm | spiral wrapping | Sn-plated copper alloy | PFA | 0.34 mm |
| 2 | twin axial cable | stranded wires | 7/0.03 mm | Sn-plated copper alloy | PFA | 0.056 mm | double spiral wrapping | Sn-plated copper alloy | composite PE tape*3 | major axis 0.52 mm minor axis 0.32 mm |
| 3 | twin axial cable | stranded wires | 7/0.03 mm | Sn-plated copper alloy | PFA | 0.056 mm | braid | Sn-plated copper alloy | composite PE tape*3 | major axis 0.52 mm minor axis 0.32 mm |

Composite PE tape*3: copper-metalized polyester tape + polyester tape

Comparative Example 1 bundled four cables, and Comparative Examples 2 and 3 bundled two cables, which were followed by connecting inner conductors in series, and bending and twisting assessment tests were performed.

As a result, the lifetimes of bending Comparative Examples were all more than 10,000 times, but some did not reach 20,000 times. Also, the lifetimes of twisting Comparative Example 1 were more than 20,000 times, but some of Comparative Examples 2 and 3 did not reach 10,000 times.

It could be verified from the above results that the samples of Examples 1-24 were excellent in bending and twisting properties, compared with the samples of Comparative Examples 1-3.

INDUSTRIAL APPLICABILITY

The present invention can provide a differential signal transmission cable which is excellent in mechanical properties such as bending and twisting. Accordingly, the invention can be suitably used in signal transmission cables for liquid crystal displays of mobile phones.

The invention claimed is:

1. A differential signal transmission cable being used in transmitting image signals of liquid crystal displays of mobile phones, comprising:

four stranded cores, each comprising an inner conductor covered with an insulation;

an outer conductor being spirally wrapped around four stranded cores in the opposite direction to a stranding direction of the cores; and a sheath provided around the outer conductor, where the diameter of the cable is 1.0 mm or less.

2. The differential signal transmission cable according to claim 1, wherein:

the stranding pitch of said cores is not more than forty times a diameter of a circle formed by connecting centers of the four cores.

3. The differential signal transmission cable according to claim 1, wherein:

said insulation uses fluorocarbon resin.

4. The differential signal transmission cable according to claim 1, wherein:

said sheath is made of a fluorocarbon resin or a laminate of a copper-plated polyester tape and a polyester tape.

5. The differential signal transmission cable according to claim 1, wherein:

when said cores are stranded, polyester filler is located at the center.

* * * * *